US007033261B2

(12) United States Patent
Huguet

(10) Patent No.: US 7,033,261 B2
(45) Date of Patent: Apr. 25, 2006

(54) TOOL FOR SURFACE TREATMENT OF AN OPTICAL SURFACE

(75) Inventor: Joël Huguet, Creteil (FR)

(73) Assignee: Essilor International (Compagnie Generale D'Optique), Paris (FR)

( * ) Notice: Subject to any disclaimer, the term of this patent is extended or adjusted under 35 U.S.C. 154(b) by 0 days.

(21) Appl. No.: 10/500,640

(22) PCT Filed: Jan. 6, 2003

(86) PCT No.: PCT/FR03/00010

§ 371 (c)(1),
(2), (4) Date: Jan. 6, 2005

(87) PCT Pub. No.: WO03/059572

PCT Pub. Date: Jul. 24, 2003

(65) Prior Publication Data

US 2005/0101235 A1 May 12, 2005

(30) Foreign Application Priority Data

Jan. 16, 2002 (FR) ..... 02 00483

(51) Int. Cl.
*B24D 17/00* (2006.01)

(52) U.S. Cl. ..... 451/490; 451/512

(58) Field of Classification Search ..... 451/490, 451/495, 523, 526, 540, 512
See application file for complete search history.

(56) References Cited

U.S. PATENT DOCUMENTS

| | | | | |
|---|---|---|---|---|
| 1,665,292 A | | 4/1928 | Brown et al. | |
| 1,701,669 A | | 2/1929 | Favre | |
| 3,395,417 A | * | 8/1968 | Matouka | 15/230 |
| 3,653,857 A | * | 4/1972 | Field | 451/490 |
| 4,287,685 A | * | 9/1981 | Marton | 451/359 |
| 5,403,231 A | * | 4/1995 | Duckworth | 451/344 |

FOREIGN PATENT DOCUMENTS

| | | |
|---|---|---|
| DE | 29 30 740 | 2/1981 |
| GB | 1 011 741 | 12/1965 |
| GB | 2 210 890 | 6/1989 |
| JP | 2000-317797 | 11/2000 |

* cited by examiner

*Primary Examiner*—Jacob K. Ackun, Jr.
(74) *Attorney, Agent, or Firm*—Young & Thompson

(57) ABSTRACT

A tool for surface treatment of an optical surface, includes a rigid support having a transverse end surface, an elastically compressible interface which is applied against and overlaps the end surface, and a soft buffer designed to be applied against the optical surface and which is pressed against and overlaps at least partly the interface opposite and perpendicular to the end surface. The buffer includes a so-called central part which is located between the end surface and a so-called peripheral part which is located transversely beyond the end surface, elastic return elements connecting the peripheral part to the support.

22 Claims, 4 Drawing Sheets

TOOL FOR SURFACE TREATMENT OF AN OPTICAL SURFACE

BACKGROUND OF THE INVENTION

The invention relates to surfacing optical surfaces.

Surfacing means any operation aimed at modifying the surface state of a previously fashioned optical surface. This refers in particular to polishing, softening or depolishing operations aimed at modifying (reducing or increasing) the roughness of the optical surface and/or reducing undulation.

The invention relates to a tool for surfacing an optical surface, which tool comprises a rigid support having a transverse end surface, an elastically compressible interface that is pressed against and covers said end surface, and a flexible buffer adapted to be pressed against the optical surface and which is pressed against and covers at least part of the interface on the side opposite to and in line with said end surface.

To reduce the roughness of the optical surface, the tool is brought into contact with the latter and a sufficient pressure is maintained thereon for the buffer to espouse the shape of the optical surface as a result of deformation of the interface.

While spraying the optical surface with a fluid, it is driven in rotation relative to the tool (or vice-versa) and the tool is swept over it.

It is generally the optical surface that is driven in rotation, its friction against the tool being sufficient to entrain the latter in rotation conjointly with it.

The surfacing operation necessitates an abrasive, which may be contained either in the buffer or in the fluid.

During surfacing, the interface, which is elastically compressible, compensates the curvature difference between the end surface of the tool support and the optical surface so that the same tool is suitable for a range of optical surfaces with different curvatures and shapes.

If the transverse dimension of the tool is comparable to the dimension of the optical surface, which is generally the case when surfacing ophthalmic lenses, the range of optical surfaces that the same tool is capable of surfacing is relatively small.

This type of tool is particularly unsuitable for surfacing optical surfaces of complex shape, known as "freeform" surfaces, in particular aspherical surfaces, which by definition have a non-uniform curvature.

Furthermore, this type of tool is also unsuitable for optical surfaces having too marked a difference of convexity or concavity relative to the tool: in the former case, the edges of the tool lose contact with the optical surface; in the latter case it is the central portion of the tool that loses contact with the optical surface, as a result of which surfacing is incomplete.

There are two ways to enlarge the range of optical surfaces that the same tool is capable of surfacing.

A first is to reduce the diameter of the tool, i.e. its overall transverse dimension, so as to restrict and localize the portion of the optical surface in contact with the tool. The contact of the tool with the surface remains more homogeneous over a localized area of this kind than over the optical surface as a whole.

However, restricting the diameter of the tool reduces its "lift" or "seating" and therefore its stability on the optical surface during surfacing.

It is then necessary to monitor, and therefore to control, the orientation of the tool so that it is optimized at all times, i.e. so that the rotation axis of the tool is colinear or substantially colinear with the normal to the optical surface at the point of intersection of said axis with the optical surface.

Now this kind of control requires the use of complex means such as a numerically controlled machine, the cost of which is generally high and may even prove prohibitive for a surfacing operation.

A second option consists in retaining the same tool diameter but making the interface more flexible, either by increasing its thickness or by reducing its elasticity.

However, because of shear forces, the interface then tends to warp or to be offset laterally, to the detriment of the efficiency and accuracy of the tool. Furthermore, shear causes fast wear, or even destruction, of the interface. Finally, the flexibility of the interface encourages and accentuates the effects of the buffer scraping against the edge of the lens, which may eventually lead to the risk of premature and/or inopportune destruction of the tool.

Given the above, manufacturers of optical surfaces, and in particular manufacturers of ophthalmic lenses, have resigned themselves to having to use a large number of tools with different sizes and curvatures in order to cover the whole of their range of optical surfaces.

SUMMARY OF THE INVENTION

Thus the invention aims in particular to solve the problems previously cited by proposing a surfacing tool which, whilst being suitable for a sufficiently vast range of optical surfaces, in terms of curvature (convexity, concavity) and shape (spherical, toric, aspherical, progressive or any combination thereof, or more generally "freeform"), is stable during surfacing and allows reliable and fast surfacing of good quality at reduced cost.

To this end, the invention proposes a tool for surfacing an optical surface, which tool comprises a rigid support having a transverse end surface, an elastically compressible interface that is pressed against and covers said end surface, and a flexible buffer adapted to be pressed against the optical surface and which is pressed against and covers at least part of the interface on the side opposite to and in line with said end surface, the buffer having a central portion that is in line with said end surface and a peripheral portion that is transversely beyond said end surface and return spring means join this peripheral portion to the support.

The combination of the peripheral portion of the buffer and the return means forms means for stabilizing the tool during surfacing, which is essentially carried out in line with the end surface of the support.

In this way it is possible to polish an optical surface whose dimension is much greater than the transverse dimension of the support without encountering the problem of the stability of the tool.

It is then possible to employ the same tool for a relatively large range of optical surfaces to be surfaced.

In particular, the same tool is suitable for surfacing surfaces whose convexity or concavity departs to a relatively great extent from that of the tool, and likewise is particularly suitable for surfacing surfaces of complex shape, in particular of toro-progressive shape.

It is therefore possible to cover the whole of a given range of lenses with a restricted set of tools varying in terms of curvature, convexity and concavity, which is beneficial from the cost point of view and in particular from the logistical point of view.

The invention as just defined has numerous embodiments.

Accordingly, in one preferred embodiment, the buffer is of one-piece construction, the central portion and peripheral portion forming a single component, which has the benefit of simplifying production.

For example, the buffer comprises a plurality of petals projecting transversely from the central portion, which corresponds to the usual shape of surfacing buffers.

Alternatively, said peripheral portion takes the form of a ring around the central portion, so that, when the buffer is in one piece, it assumes the shape of a disc when it is unstressed.

Additionally, the interface has a central portion that is in line with said end surface and a peripheral portion that is transversely beyond said end surface and is between the peripheral portion of the buffer and the return means.

This increases the flexibility of the assembly.

For example, the peripheral portion of the interface when unstressed assumes the shape of a ring around the central portion of the interface.

The tool further comprises a deformable ring transversely around the support and between the peripheral portion of the interface and the return means.

It has been found that this makes surfacing more regular.

To make the surfacing even more regular, the ring preferably has a circular longitudinal section.

Additionally, in one particular embodiment, the interface is of one-piece construction and its central portion and peripheral portion form a single component, which has the benefit of simplifying production.

When unstressed, the interface therefore assumes the shape of a disc, for example.

The return means comprise a leaf spring projecting transversely from the support, for example, joined to the support at a first end and to the peripheral portion of the buffer at a second end.

The leaf spring is preferably rigidly anchored in the support at its first end, which has the benefit of making the tool stable.

In one particular embodiment, the return means comprise a star-shaped component fixed to the support and provided with branches each forming a leaf spring.

The use of a component of this kind, which is otherwise of relatively simple construction, regularizes the return force acting on the peripheral portion of the buffer during surfacing.

For example, the support comprises two jaws fixed together, the star-shaped part having a central portion that is clamped between the two jaws and from which its branches project.

When the buffer is of one-piece construction and comprises a plurality of petals as a peripheral portion, as previously mentioned in one of the embodiments described, and each branch of the star-shaped part is preferably in line with a petal.

For example there are seven petals and seven branches, which is sufficient to ensure fast surfacing of good quality.

The end surface may be plane, concave or convex, which enables a large number of optical surfaces to be surfaced using a restricted number of tools.

BRIEF DESCRIPTION OF THE DRAWINGS

Other features and advantages of the invention will become apparent in the light of the following description of one embodiment of the invention provided by way of nonlimiting example, the description being given with reference to the appended drawings, in which.

DETAILED DESCRIPTION OF THE PREFERRED EMBODIMENTS

Figure 1:
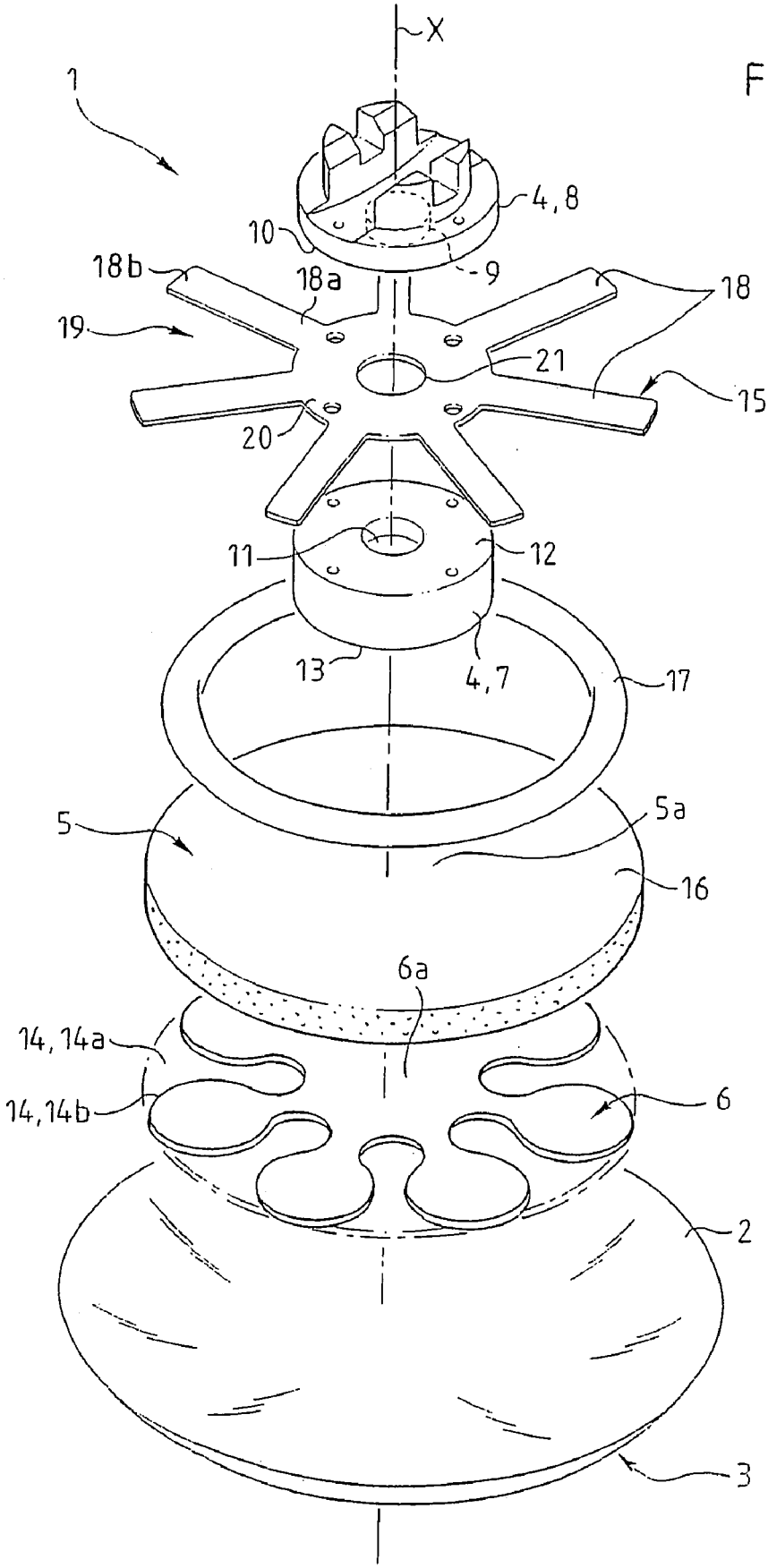
FIG. 1 is an exploded perspective view of a tool conforming to the invention and an ophthalmic lens having an optical surface to be surfaced.
Figure 2:
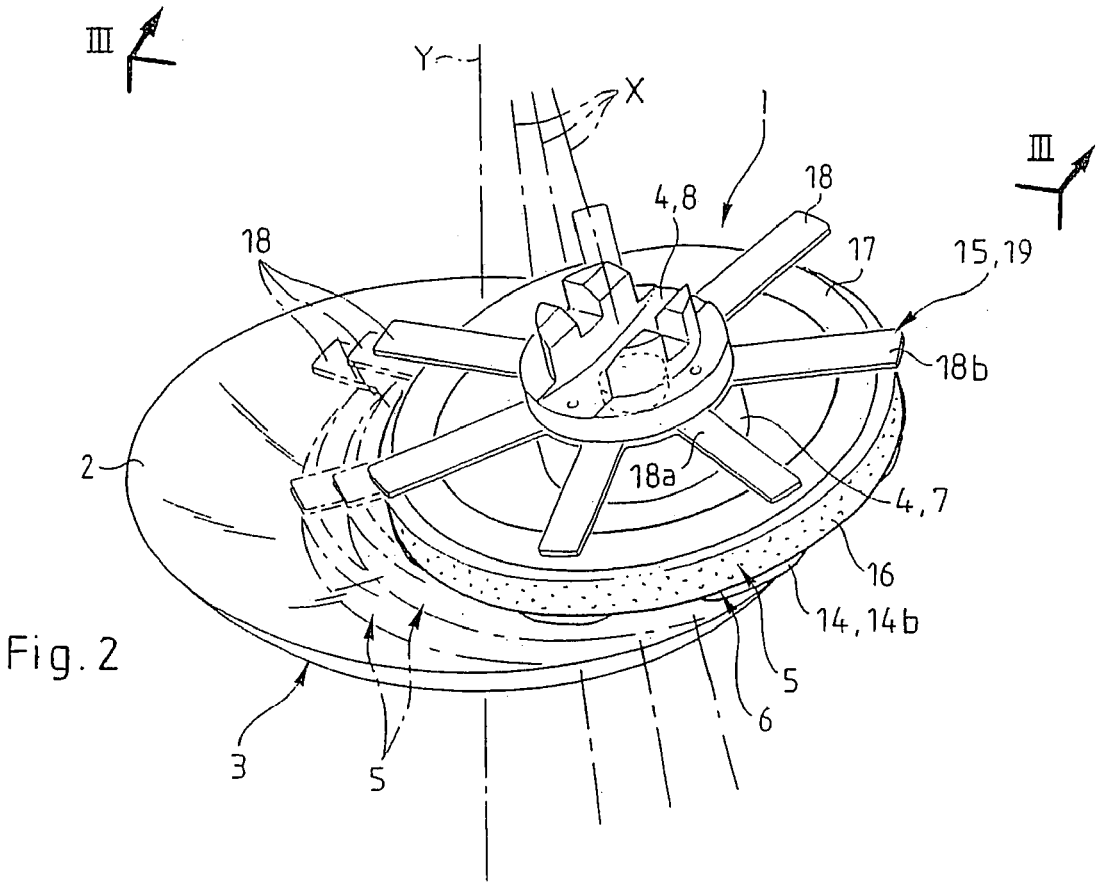
FIG. 2 is a perspective view of the tool from FIG. 1 when assembled, shown during surfacing of the optical surface of the lens from FIG. 1; to indicate the movement of the tool relative to the lens during surfacing, the tool is shown in three positions, two of which are depicted in chain-dotted outline.
Figure 3:
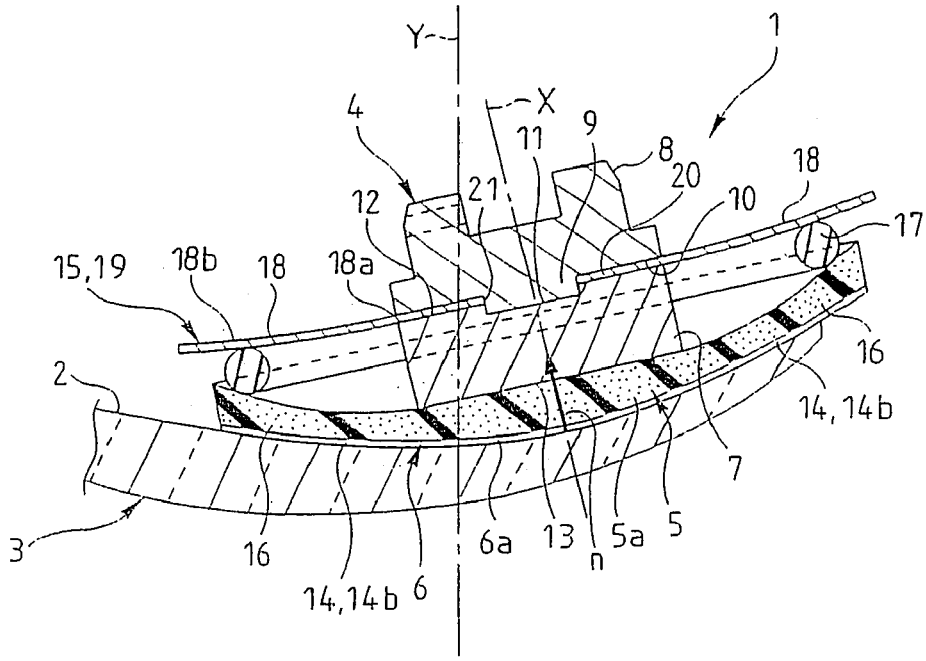
FIG. 3 is a partial view of the tool and the lens from FIG. 2 in section taken along the line III—III.

FIG. 1 shows a tool 1 for surfacing an optical surface 2, in this instance one face of an ophthalmic lens 3. In FIGS. 1 to 3 the optical surface 2 concerned is a concave surface, but it could equally well be a convex surface.

The tool 1 is formed of a stack of at least three components, namely a rigid component 4, an elastically compressible component 5 and a flexible component 6; these components are respectively referred to hereinafter as the support, the interface and the buffer.

As may be seen in FIG. 1 in particular, the support 4 comprises two jaws, namely a bottom jaw 7 and a top jaw 8 which are adapted to be stacked and nested one within the other by means of a pin 9 projecting from one face 10 of the top jaw 8 and adapted to lodge in a complementary hole 11 facing it in one face 12 of the bottom jaw 7.

As may be seen in FIG. 1, the support 4 is a circular cylinder with an axis X of symmetry that defines a longitudinal direction.

The figure shows the normal n to the optical surface 2 at the point of intersection of the axis X of symmetry of the tool 1 therewith.

On the side opposite its face 12 in which the hole 11 is formed, the bottom jaw 7 has a substantially transversely extended end surface 13 against which the interface 5 is pressed, covering it.

The buffer 6 is pressed against the interface 5 on the other side thereof to the support 4.

To be more precise, the buffer 6 covers at least in part the side of the interface 5 opposite and in line with the end surface 13.

By means of an abrasive contained in the spraying fluid or incorporated into the buffer 6 itself, the rubbing of the buffer 6 against the optical surface 2 removes surface material from the optical surface 2 in order to modify the surface state, as explained below.

According to the invention, the buffer has, firstly, a central portion 6*a* that is in line with the end surface 13 and, secondly, a peripheral portion 14 that is transversely beyond the end surface 13.

The peripheral portion 14 is connected to the support 4 by return spring means 15.

The peripheral portion 14 is in line with the central portion 6*a* and, at rest, substantially coplanar with it.

In a preferred embodiment shown in FIGS. 1 to 6, the buffer 6 is of one-piece construction, the peripheral portion 14 being joined to the central portion 6*a* so that in fact they form a single component.

In a preferred embodiment depicted in thicker line in FIG. 1, the buffer 6 is in the shape of a flower and thus comprises a plurality of petals 14*b* projecting transversely from the central portion 6*a* to form the peripheral portion 14 of the buffer 6 and each extending transversely beyond the end surface 13.

In a variant represented in chain-dotted outline in FIG. 1, the peripheral portion 14 takes the form of a ring 14*a* around the central portion 6*a*.

In this case, the buffer 6, when it is of one-piece construction, assumes the shape when it is unstressed of a disc whose thickness is small compared to its diameter, as shown in FIG. 1, the peripheral portion 14, 14*a* therefore forming a flange relative to the end surface 13.

Return means 15 described later may be placed directly between the support 4 and the peripheral portion 14 of the buffer 6, i.e. the flange 14*a* or the petals 14*b* in practice.

However, in a preferred embodiment shown in the figures, the interface 5 comprises not only a central portion 5*a* that is in line with the end surface 13 but also a peripheral portion 16 that is transversely beyond the end surface 13.

For example, this peripheral portion 16 is in line with the central portion 5*a* and, when it is unstressed, assumes the shape of a ring around the central portion 5*a*, in fact between the peripheral portion 14 of the buffer 6 and the return means 15.

As may be seen in FIGS. 1 to 6, the interface 5 is of one-piece construction, its central portion 5*a* and peripheral portion 16 being joined together to form a single component, the peripheral portion 16 forming a flange relative to the end surface 13.

Accordingly, when it is unstressed, the one-piece construction interface 5 assumes the shape of a disc whose thickness is small compared to its transverse dimension (i.e. its diameter), for example.

If the interface 5 and the buffer 6 are both of one-piece construction, they have comparable transverse dimensions. In particular, when each takes the form of a disc, for convenience of manufacture they are preferably of the same diameter. However, it is equally possible to use a buffer having a diameter different from that of the interface, in particular a greater diameter, in order to attenuate the effects of the edge of the tool on the worked surface.

Moreover, for reasons that emerge hereinafter, in an embodiment shown in FIGS. 1 to 6 there is a deformable ring 17 between the peripheral portion 16 of the interface 5 and the return means 15.

In practice, this ring 17 is fixed to the peripheral portion 16 on the opposite side thereof to the buffer 6, i.e. on the same side as the support 4, so that the latter is surrounded by the ring 17.

The ring 17 preferably has a circular longitudinal section, but could equally have a section of more complex shape, in particular oblong, polygonal, rectangular or square shape. Moreover, it is placed on the peripheral portion 16 concentrically with the support 4.

The return means 15 are described next.

They comprise at least one leaf spring 18 that projects transversely from the support 4 and is connected rigidly to the support 4 at a first end 18*a* and connected to the peripheral portion 14 of the buffer 6 by a free second end 18*b* opposite the first end 18*a*.

As a result, a force applied longitudinally to the peripheral portion 14 in line with the leaf spring 18 deforms it, a reaction force opposite to said force being exerted on the peripheral portion 14.

In practice, the return means 15 comprise a plurality of these leaf springs 18, distributed uniformly around the periphery of the support 4 to act on the whole of the peripheral portion 14 of the buffer 6.

In an embodiment shown in FIGS. 1 and 2 in particular, the return means 15 in fact take the form of a star-shaped part 19 fixed rigidly to the support 4.

This star-shaped part 19 has a central portion 20 from which project branches 18 each forming a leaf spring extending radially in a horizontal plane.

To fix the star-shaped part 19 to the support 4, its central portion 20 is in practice clamped between the jaws 7, 8 of the support 4 and centered by means of a hole 21 through its center through which the pin 9 on the top jaw 8 passes, the resulting assembly being retained by fixing means such as screws passing through the top jaw 8 and the central portion 20 of the star-shaped part 19 and screwed into the bottom jaw 7.

When, in the embodiment previously described, the one-piece construction buffer 6 comprises a plurality of petals 14*b*, there are the same number of branches 18 on the star-shaped part 19 as there are petals 14*b*, the star-shaped part 19 being oriented so that each branch 18 is in line with a petal 14*b*. Accordingly, if the buffer 6 comprises seven petals 14*b*, the star-shaped part 19 comprises seven branches 18 each acting as the return spring for one petal 14*b*.

Although several embodiments are provided, as mentioned above, it has been found that the tool 1 corresponding to the embodiment shown in FIGS. 1 to 6 provides particularly satisfactory surfacing.

In this embodiment, the buffer 6 and the interface 5 are both of one-piece construction, the interface 5 taking the form of a disc, the buffer 6 being flower-shaped, and the return means 15 taking the form of a star-shaped part 19 as previously described, and a circular section deformable ring 17 is placed between the free ends 18*b* of the branches 18 and the interface 5.

The ring 17 is fixed to the interface 5 and to the free ends 18*b* of the branches 18 by any means, although adhesive bonding is preferred, in particular because of its simplicity.

In the embodiment shown, the diameters of the interface 5, the buffer 6 and the star-shaped part 19 are at least twice that of the support 4.

Moreover, in the case of surfacing an ophthalmic lens, the diameters of the interface 5 and the buffer 6 are made substantially equal to the diameter of the lens 3 so that the diameter of the support 4 is much less than the diameter of the lens 3.

FIGS. 2 and 3 depict the use of the tool 1.

Here the tool is being used to surface or soften an aspherical convex face 2 of an ophthalmic lens.

The lens 3 is mounted on a rotary support (not shown) which drives it in rotation about a fixed axis Y.

The tool 1 is pressed against the face 2 with sufficient force for the buffer 6 to espouse its shape. The tool 1 is free to rotate and is off-center compared to the optical surface 2. The tool may be driven in rotation by appropriate means.

The friction between the optical surface 2 and the buffer 6 is sufficient to drive rotation of the tool 1 in the same direction as that of the lens 3 about an axis substantially coincident with the axis X of symmetry of the support 4.

The optical surface 2 is sprayed with a fluid that is abrasive or non-abrasive according to whether the buffer has this function itself or not.

To sweep the whole of the optical surface 2, the tool 1 is moved during surfacing along a radial trajectory, the point of intersection of the rotation axis X of the tool 1 with the optical surface 2 moving to and fro between two change of direction points, namely an outer change of direction point A and an inner changer of direction point B, both these points being at a distance from the rotation axis Y of the lens 3.

Thanks to the compressibility of the central portion 5*a* of the interface 5, the central portion 6*a* of the buffer 6 is deformed to espouse the shape of the optical surface 2.

Thanks to deformation of the leaf springs 18, the peripheral portion 14 of the buffer 6 is deformed to espouse the shape of the optical surface 2.

Given the rigidity of the support 4, material is removed mostly in line with the end surface 13, i.e. material is essentially removed by the central portion 6*a* of the buffer 6.

The peripheral portions 14 of the buffer 6 and 16 of the interface 5 have an essentially stabilizing role, firstly because of the increased lift or seating of the tool 1 relative to a standard tool whose buffer and interface would be limited to the central portions 5*a*, 6*a* and secondly thanks to the return means 15, which maintain permanent contact between the peripheral portion 14 of the buffer 6 and the optical surface 2.

The deformable ring 17 smoothes the distribution of the stress exerted on the perimeter of the interface 5 and thus on the buffer 6 by the leaf springs 18.

As a result of this, regardless of the location of the tool 1 on the optical surface 2, and regardless of its rotation speed, its rotation axis X is permanently colinear or substantially colinear with the normal n to the optical surface 2, so that the orientation of the tool 1 is optimized at all times.

Figure 4:
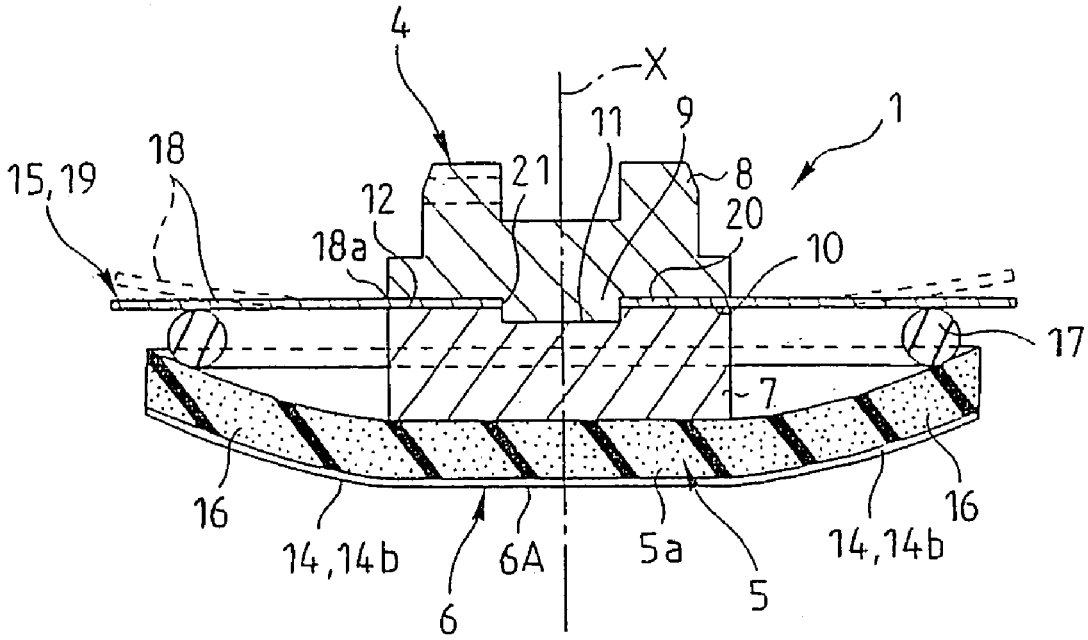
FIG. 4 is a sectional view in elevation of the tool from FIG. 3 shown on its own and at rest; the chain-dotted outline depiction of the spring return means shows their deformation during surfacing.

In an embodiment shown in FIGS. 3 and 4, the end surface 13 of the support 4 is plane.

Thus the tool 1 is suitable for surfacing a certain range of optical surfaces 2 with different curvatures.

Figure 5:
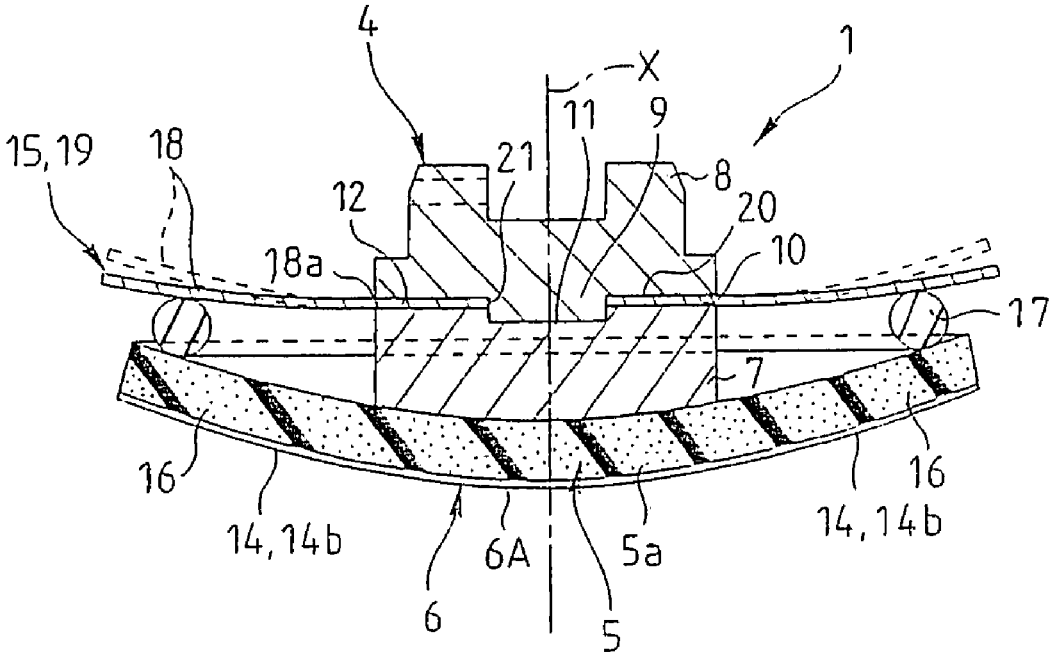
FIG. 5 is a view analogous to FIG. 4 of a first variant.
Figure 6:
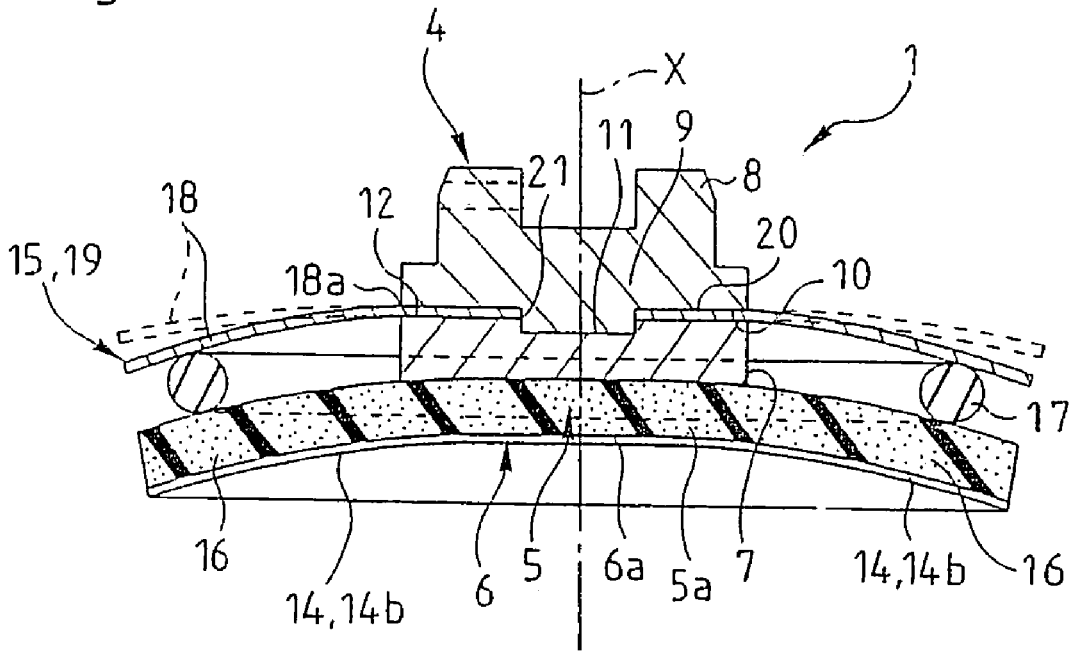
FIG. 6 is a view analogous to FIGS. 4 and 5 of a second variant.
Figure 7:
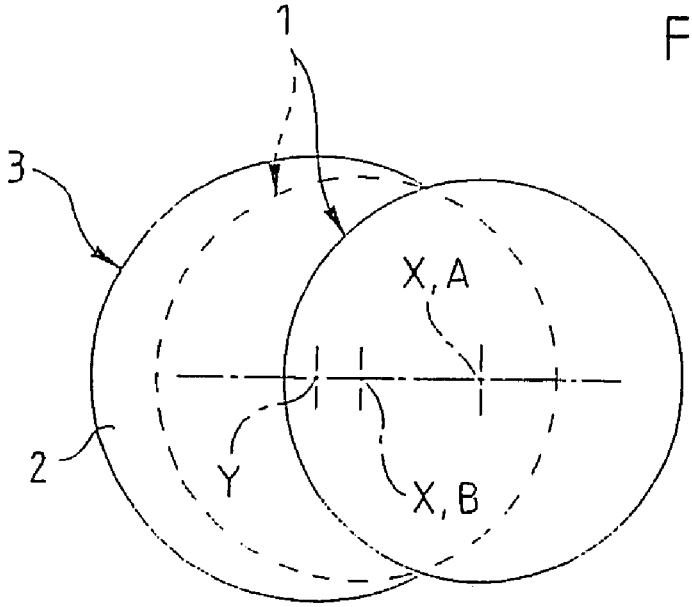
FIG. 7 is a diagrammatic plan view showing an ophthalmic lens during surfacing by means of a tool conforming to the invention, the tool being shown in two positions it assumes when sweeping over the optical surface, one of which positions is depicted in chain-dotted outline.

To modify the adaptability of the tool 1, it is possible to prestress the return means 15 by twisting the leaf springs 18 so that they are already flexed when unstressed, in one direction (FIG. 5) or the other (FIG. 6).

If the leaf springs 18 are straight when unstressed (FIG. 4) or bent away from the end surface 13 (FIG. 5), the tool 1 is intended for concave optical surfaces 2, whereas if the leaf springs 18 when unstressed are bent toward the end surface 13 (FIG. 6), the tool 1 is intended for convex optical surfaces 2.

Moreover, in a first variant shown in FIG. 5, the end surface 13 of the support 4 is convex, and the tool 1 is intended for optical surfaces 2 having a more pronounced concavity.

In a second variant shown in FIG. 6, the end surface 13 of the support 4 is concave, and the tool 1 is intended for optical surfaces 2 of more pronounced convexity.

It is possible, of course, to combine the concave or convex end surface 13 with prestressing of the return means 15 as described above.

The three tools 1 shown in FIGS. 4, 5 and 6, i.e. whose end surfaces 13 are respectively plane, convex and concave, are sufficient to cover a wide range of convex and concave optical surfaces 2 to be surfaced of varied shape: spherical, toric, progressive aspherical or any combination thereof, or more generally of the freeform type.

In one embodiment (not shown), the return means take the form of a helicoidal spring with a first end anchored in the support and a second end fixed to the peripheral portion of the buffer. This spring has a frustoconical profile, for example, being flared in the direction from the support toward said peripheral portion.

It has been shown that a tool 1 as previously described is used in a manner that corresponds to a standard method well known to the person skilled in the art, so that no particular adaptation of the machines usually employed is necessary.

The invention claimed is:

1. A tool for surfacing an optical surface, said tool comprising:

a rigid support having a transverse end surface;

a return spring means connected to said support;

an elastically compressible interface that is pressed against and covers said end surface; and a flexible buffer adapted to be pressed against the optical surface and which is pressed against and covers at least part of the interface on the side opposite to and in line with said end surface, wherein the buffer has a central portion that is in line with said end surface and a peripheral portion that is transversely beyond said end surface, said tool being structured and arranged for surfacing substantially at the central portion, said return spring means joining said peripheral portion to the support, said peripheral portion and said return spring means forming, in combination, a means for stabilizing the tool during surfacing.

2. Tool according to claim 1, wherein the buffer is of one-piece construction, the central portion and peripheral portion forming a single component.

3. Tool according to claim 2, wherein the buffer comprises a plurality of petals projecting transversely from the central portion.

4. Tool according to claim 1, wherein said peripheral portion takes the form of a ring around the central portion.

5. Tool according to claim 4, wherein the buffer is of one-piece construction and when unstressed assumes the shape of a disc.

6. Tool according to claim 1, wherein the interface has a central portion that is in line with said end surface and a peripheral portion that is transversely beyond said end surface and is between the peripheral portion of the buffer and the return means.

7. Tool according to claim 6, wherein the peripheral portion of the interface when unstressed assumes the shape of a ring around the central portion of the interface.

8. Tool according to claim 7, further comprising a deformable ring transversely around the support and between the peripheral portion of the interface and the return means.

9. Tool according to claim 8, wherein the ring has a circular longitudinal section.

10. Tool according to claim 6, wherein the interface is of one-piece construction and its central portion and peripheral portion form a single component.

11. Tool according to claim 10, wherein when unstressed the interface assumes the shape of a disc.

12. Tool according to claim 1, wherein said return means comprise a leaf spring projecting transversely from the support.

13. Tool according to claim 12, wherein said leaf spring is joined to the support at a first end and to the peripheral portion of the buffer at a second end.

14. Tool according to claim 13, wherein said leaf spring is rigidly anchored in the support at its first end.

15. Tool according to claim 12, wherein the return means comprise a star-shaped component fixed to the support and provided with branches each forming a leaf spring.

16. Tool according to claim 15, wherein the support comprises two jaws fixed together, the star-shaped part having a central portion that is clamped between the two jaws and from which its branches project.

17. Tool according to claim 15, wherein the buffer is of one-piece construction and comprises a plurality of petals projecting transversely from its central portion and each branch is in line with a petal.

18. Tool according to claim 17, comprising seven said petals and seven said branches.

19. Tool according to claim 1, wherein the end surface of the support is plane.

20. Tool according to claim 1, wherein the end surface of the support is convex.

21. Tool according to claim 1, wherein the end surface of the support is concave.

22. A tool for surfacing an optical surface, said tool comprising:

a rigid support having a transverse end surface and that is rotatable about a first axis;

a return spring connected to said rigid support;

an elastically compressible element that is pressed against and covers said end surface; and a flexible buffer element adapted to be pressed against the optical surface and which contacts and covers at least part of the compressible element on a side opposite to and in line with said end surface, wherein said buffer element has a central portion that is aligned with said end surface and a peripheral portion that extends transversely beyond said end surface, said return spring joining said peripheral portion to said rigid support, and wherein said first axis is permanently colinear or substantially colinear with a normal to the optical surface.

* * * * *